US009617998B2

(12) United States Patent
Knutsson et al.

(10) Patent No.: US 9,617,998 B2
(45) Date of Patent: Apr. 11, 2017

(54) ROOTS-STYLE BLOWER WITH LEAKAGE MECHANISMS

(71) Applicant: VOLVO CAR CORPORATION, Gothenburg (SE)

(72) Inventors: Magnus Knutsson, Floda (SE); Anders Ohlson, Hisings-Backa (SE); Ragnar Burenius, Trollhattan (SE); Johan Brunberg, Molndal (SE); Amir Toma, Gothenburg (SE)

(73) Assignee: VOLVO CAR CORPORATION (SE)

( * ) Notice: Subject to any disclaimer, the term of this patent is extended or adjusted under 35 U.S.C. 154(b) by 195 days.

(21) Appl. No.: 14/535,831

(22) Filed: Nov. 7, 2014

(65) Prior Publication Data

US 2015/0132171 A1 May 14, 2015

(30) Foreign Application Priority Data

Nov. 8, 2013 (EP) ..... 13192052

(51) Int. Cl.
*F03C 2/00* (2006.01)
*F03C 4/00* (2006.01)
(Continued)

(52) U.S. Cl.
CPC ..... *F04C 29/065* (2013.01); *F04C 15/0026* (2013.01); *F04C 15/0049* (2013.01);
(Continued)

(58) Field of Classification Search
CPC .. F04C 15/0026; F04C 15/0049; F04C 15/06; F04C 15/062; F04C 18/07;
(Continued)

(56) References Cited

U.S. PATENT DOCUMENTS 4,768,934 A * 9/1988 Soeters, Jr. ..... F04C 29/122 418/15
2004/0194766 A1 10/2004 Prior et al.
(Continued)

FOREIGN PATENT DOCUMENTS

EP 0225070 A1 6/1987
JP 2004270545 A 9/2004

OTHER PUBLICATIONS

Extended European Search Report Dated Jan. 24, 2014, Application No. 13192052.2-1608, Applicant Volvo Car Corporation, 9 Pages.

*Primary Examiner* — Theresa Trieu
(74) *Attorney, Agent, or Firm* — Brooks Kushman P.C.

(57) ABSTRACT

The disclosure concerns a Roots-type blower comprising a housing defining first and second transversely overlapping cylindrical chambers and at least one inlet port and an outlet port; first and second meshed, lobed rotors, each lobe having a top land sealingly cooperating with the cylindrical chambers; a plurality of control volumes for transfer of fluid, each control volume being defined by a pair of adjacent lobes on one of the rotors, and at least one of the cylindrical chambers; and blowholes formed within the cylindrical chambers in connection with meshing of the lobes of the first and second rotors. The blower further comprises at least one backflow slot extending through the housing wall of each cylindrical chamber for effecting a leakage of fluid from downstream the at least one outlet port into a control volume.

20 Claims, 7 Drawing Sheets

(51) Int. Cl.

| | |
|---|---|
| ***F04C 2/00*** | (2006.01) |
| ***F04C 29/06*** | (2006.01) |
| ***F04C 15/00*** | (2006.01) |
| ***F04C 15/06*** | (2006.01) |
| ***F04C 29/12*** | (2006.01) |
| ***F04C 18/12*** | (2006.01) |
| ***F04C 18/107*** | (2006.01) |

(52) U.S. Cl.
CPC ..... *F04C 15/06* (2013.01); *F04C 18/107* (2013.01); *F04C 18/126* (2013.01); *F04C 29/122* (2013.01)

(58) Field of Classification Search
CPC ..... F04C 18/126; F04C 29/065; F04C 29/12; F04C 29/122
USPC ..... 418/201.1, 15, 78, 206.1, 206.4
See application file for complete search history.

(56) References Cited

U.S. PATENT DOCUMENTS

| | | | |
|---|---|---|---|
| 2006/0263230 | A1 | 11/2006 | Swartzlander |
| 2012/0014825 | A1 | 1/2012 | Izawa et al. |

* cited by examiner

A-A

ROOTS-STYLE BLOWER WITH LEAKAGE MECHANISMS

CROSS-REFERENCE TO RELATED APPLICATIONS

This application claims foreign priority benefits under 35 U.S.C. §119(a)-(d) to European patent application number EP 13192052.2, filed Nov. 8, 2013, which is incorporated by reference in its entirety.

TECHNICAL FIELD

This disclosure relates to Roots-type blowers and more particularly to such blowers in which the lobes are twisted. Such Roots-type blowers are commonly used for pumping volumes of air in applications such as boosting or supercharging internal combustion engines of vehicles.

BACKGROUND

In vehicle motor applications, Roots-type blower superchargers are used for transferring volumes of air into the combustion chambers of an engine. The transferred volumes of air are greater than the displacement of the engine, thereby increasing the air pressure within the combustion chambers which results in greater engine output power.

A Roots-type blower is a positive displacement lobe pump which operates by pumping a fluid with a pair of meshing, lobed rotors provided in overlapping rotor chambers. Fluid is trapped in pockets surrounding the lobes and carried from the intake side to an outlet side.

Modern Roots-type blowers typically have twisted lobes, i.e., the rotor lobes define a helix angle greater than zero relative to the axial direction of the rotor. Another significant parameter in a Roots-type blower is the twist angle of each lobe, i.e., the angular displacement in degrees when travelling along a lobe from one end of the rotor to the other end of the rotor.

A long-known problem with Roots-type blowers is that they generate high levels of pulsation noise. As disclosed in US 2006/0263230 A1, the noise can be reduced by increasing the helix angle of the lobes. A large helix angle results in many "blowholes" being formed in connection with meshing of the lobes as the rotors rotate. The blowholes permit communication between adjacent pockets of fluid, which allows for pressure equalization prior to opening the outlet port. Pressure equalization is known to reduce air turbulence (pulsation) and hence pulsation noise.

However, even with many blowholes a Roots-type blower still may produce a considerable amount of noise. Especially, a Roots-type blower may cause a lot of nuisance in a vehicle if run hard at low engine speeds, as the engine at low speeds does not produce sufficient noise to drown the noise from the Roots-type blower.

There is thus a need for an improved Roots-type blower at least partly removing the above mentioned disadvantage.

SUMMARY

An object of the present disclosure is to provide a Roots-type blower having a reduced level of NVH (Noise Vibration Harshness).

The disclosure concerns a roots-type blower. The blower comprising a housing defining first and second transversely overlapping cylindrical chambers, and the housing comprising a first end wall and a second end wall. The housing defining at least one inlet port adjacent said first end wall and at least one outlet port adjacent said second end wall. The blower further comprises first and second meshed, lobed rotors disposed, respectively, in said first and second cylindrical chambers. Each rotor includes a plurality of lobes. Each lobe having first and second axially facing end surfaces sealingly cooperating with said first and second end walls, respectively, and a top land sealingly cooperating with said cylindrical chambers. Each lobe further having its first and second axially facing end surfaces defining a twist angle and a helix angle. The blower further comprises a plurality of control volumes for transfer of fluid from the at least one inlet port to the at least one outlet port. Each control volume being defined by a pair of adjacent lobes on one of the rotors, and at least one of the cylindrical chambers, first end wall, and/or second end wall. The blower also has a leakage mechanism for effecting a leakage of fluid between adjacent control volumes. The leakage mechanism including blowholes formed within the cylindrical chambers in connection with meshing of the lobes of the first and second rotors.

According to one aspect of the disclosure the Roots-type blower comprises an additional leakage mechanism in form of at least one backflow slot extending through the housing wall of each cylindrical chamber for effecting a leakage of fluid from downstream the at least one outlet port into a control volume prior to traversal of the at least one outlet port boundaries by the top land of the lead lobe of said control volume.

During operation of the blower the fluid pressure downstream the outlet will generally be significantly larger than the fluid pressure at the inlet port due to the pumping effect of the blower. The fluid pressure within the control volumes will thus also be significantly smaller than the pressure downstream the outlet port. When the control volume opens to the outlet port high pressure fluid will consequently rapidly flow into the control volume and thereby generating turbulence and noise. Roots-type blowers having blowholes as leakage mechanism provides a certain level of pressure equalization between adjacent control volumes prior to opening to the outlet port. However, it has been found that Roots-type blowers having blowholes as their only leakage mechanism suffer from insufficient pressure equalization. The insufficient pressure equalization occurs even when a relatively high twist angle is used, disclosure, at least 90 degrees, whereby an increased twist angle results in increased internal leakage for several reasons. For example, with maintained rotor and housing length, maintained rotor speed and merely increased twist angle, an increased number of blowholes are generally present simultaneously in the blower, the existence of each blow hole over time is prolonged, and since the axial air speed within each control volume is reduced there is less likelihood of generating a vacuum at the inlet port, such that increased air pressure within each control volume and reduced turbulence is enabled. The advantage of providing at least one additional leakage mechanism according to the disclosure is further improved pressure equalization between adjacent control volumes prior to opening to the outlet port, such that the NVH level generated by the Roots-type blower is further reduced.

According to a further aspect of the disclosure the Roots-type blower comprises a leakage mechanism for effecting a leakage of fluid between adjacent control volumes, wherein said leakage mechanism comprises at least one bleed recess provided in the second end wall, and wherein said bleed recess provides a passage between the second axially facing end surface of a lobe and the second end wall such that fluid is enabled to leak between adjacent control volumes. This solution, which is technically different but exhibiting essentially the same technical effect and solving essentially the same problem, also provides pressure equalization between adjacent control volumes prior to opening to the outlet port, and thereby also and a reduced NVH level. The size, shape and positioning of the bleed recess can be selected according to the specific circumstances to obtain a desired balance of noise dampening and pumping efficiency. Bleed recesses and backflow slots are not mutually exclusive, but may be used in the same blower.

Further advantages are achieved by implementing one or several of the features of the dependent claims.

In one aspect of the disclosure, the additional leakage mechanism comprises at least one individual backflow slot provided on each side of a center line extending axially in a wall of the housing. A backflow slot is an opening in the housing. The at least one backflow slot allows the control volume to at least partly equalize in pressure with the outflow duct prior to opening to the outlet port. Hence, the aforementioned pressure difference is reduced prior to opening to the outlet port which results in reduced noise.

Moreover, by providing each cylindrical chamber with at least one individual backflow slot any interference between the working chambers caused by the backflow slot may be eliminated.

The design, e.g., number, size, shape, and position, of the at least one backflow slot may be adapted to minimize noise in a specific installation of the blower. A specific installation may be for example a specific model of a vehicle. The specific design of each model of a vehicle determines the acoustics within the vehicle. Usually, sound of some frequencies fade away quite immediately, while other frequencies are more long-lived or even amplified. The frequency of the fundamental tone of the noise generated by the Roots-type blower corresponds to the rotational frequency of the rotors. Several overtones, i.e., multiples of the fundamental frequency, are also generated. The size, shape and position of the at least one backflow slot affects which overtones that are generated and to what extent. Thus, the backflow slots may be designed to get rid of certain overtones that would otherwise be long-lived or even amplified in the specific installation.

The at least one backflow slot may have a substantially rectangular shape. The at least one backflow slot may have an elongated shape and a length in range of 3-25 millimeters, preferably 4-20 millimeters, and more preferably 4-15 millimeters.

The additional leakage mechanism may comprise at least two individual backflow slots provided on each side of a center line, more preferably at least three individual backflow slots provided on each side of a center line. Provision of many backflow slots enables more fluid to leak and therefore better pressure equalization. Alternatively, one or a few backflow slot of large size could be used instead of a plurality of smaller backflow slots. However, design elements such as reinforcement lines in the housing may hinder the use of large backflow slots, while smaller backflow slots readily may fit between the hindering design elements.

The individual backflow slots on either side of the center line are preferably arranged along a slot axis having a slot axis angle to the longitudinal direction of the housing, wherein said slot axis angle is smaller than the helix angle of the lobes, such that the individual backflow slots along each slot axis sequentially enables a fluid flow passage to the control volume as the top land of the lead lobe of the control volume progressively traverses the slot axis. The advantage of such an arrangement is that the pressure within the control volume gradually is equalized with the pressure in the outflow duct as more and more backflow slots open. This gradual pressure equalization reduces turbulence even more, and hence results in even more efficient noise reduction.

The at least one bleed recess has an angular width greater than an angular width of the lobe.

In one aspect of the disclosure, at least two bleed recesses are provided in the second end wall, wherein at least one bleed recess is associated with each individual cylindrical chamber. This arrangement reduces interference between the first and second control volumes.

Each rotor may typically comprise between three and five lobes. More specifically, each rotor comprises four lobes.

The twist angle of the lobes may be at least 120°, and more specifically at least 140°. A higher twist angle enables a higher helix angle for a rotor of a given length. And an increased helix angle gives rise to a larger number of blowholes being created within the cylindrical chambers. And furthermore, an increased helix angle results in a lower linear velocity of the blowholes along the rotor. In other words, an increased helix angle leads to more blowholes, which blowholes are also present for a longer period of time. Consequently, there are more blowholes for fluid to leak through, and the leakage can take place during a longer period of time. This results in increased leakage and hence in increased pressure equalization through the blowholes and therefore reduced noise.

Said twist angle may also be less than 360°, more specifically less than 300°, and even more specifically less than 240°.

BRIEF DESCRIPTION OF THE DRAWINGS

In the detailed description of the disclosure given below reference is made to the following figures, in which.

DETAILED DESCRIPTION

As required, detailed embodiments are disclosed herein. However, it is to be understood that the disclosed embodiments are merely exemplary and that various and alternative forms may be employed. The figures are not necessarily to scale. Some features may be exaggerated or minimized to show details of particular components. Therefore, specific structural and functional details disclosed herein are not to be interpreted as limiting, but merely as a representative basis for teaching one skilled in the art.

Various aspects of the disclosure will hereinafter be described in conjunction with the appended drawings to illustrate and not to limit the disclosure, wherein like designations denote like elements, and variations of the inventive aspects are not restricted to the specifically shown embodiments, but are applicable on other variations of the disclosure.

Figure 1:
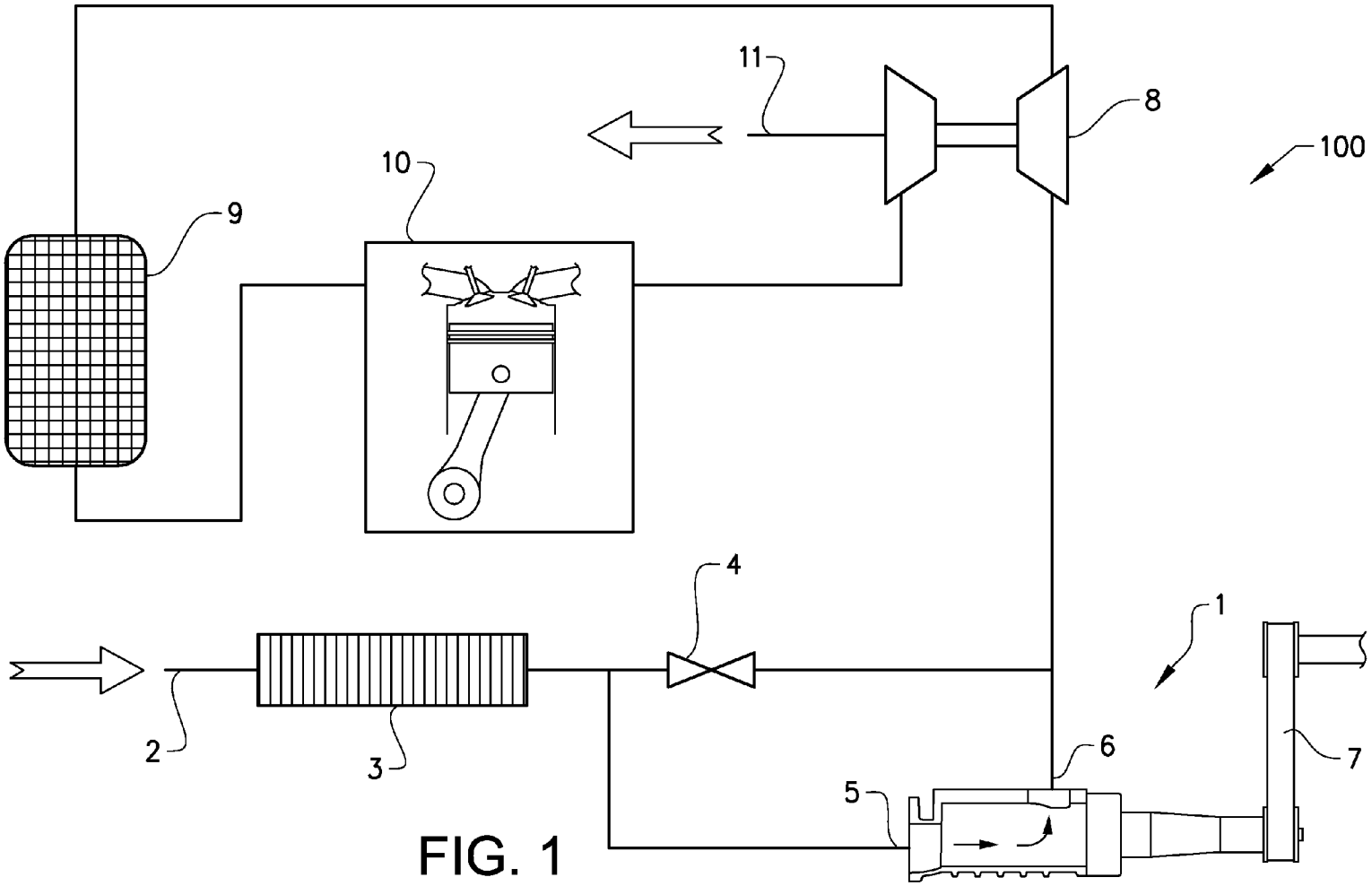
FIG. 1 shows a schematic overview of an engine aspiration assembly comprising a Roots-type blower.

FIG. 1 shows a schematic overview of an engine aspiration assembly 100 comprising a Roots-type blower 1. Typically, such an engine assembly is found in a motor vehicle, such as for example an automobile, truck, bus or the like. In this example, the Roots-type blower 1 is used in combination with a turbocharger 8 for transferring air into the combustion chambers of the internal combustion engine 10. The transferred volumes of air are greater than the displacement of the engine 10, thereby increasing the air pressure within the combustion chambers which results in greater engine output power. Air is let into the engine aspiration assembly 100 via an air intake 2 and passes via an air filter 3 for removal of particles harmful to the assembly 100. A bypass valve 4 controls if the incoming air is fed via the Roots-type blower 1 or directly to the turbocharger 8. For example, the pumping of the Roots-type blower 1 may be needed at low engine speeds, while being superfluous at higher engine speeds. If the bypass valve 4 is open towards the Roots-type blower 1, air is fed into the Roots-type blower 1 via an inflow duct 5. The pumping mechanism of the Roots-type blower is mechanically driven by a drive belt 7 connected to the engine crankshaft. After being pumped, the air leaves the Roots-type blower 1 via an outflow duct 6 and is passed on to the turbocharger 8 in which the air may be further pumped. After having passed the turbocharger 8, the air is cooled by an intercooler 9 before entering the combustion chambers of the engine 10. After combustion, exhaust gases are ejected from the engine 10. The exhaust gases drive the turbocharger 8 before leaving the engine aspiration assembly 100 via an exhaust outlet 11.

Figure 2:
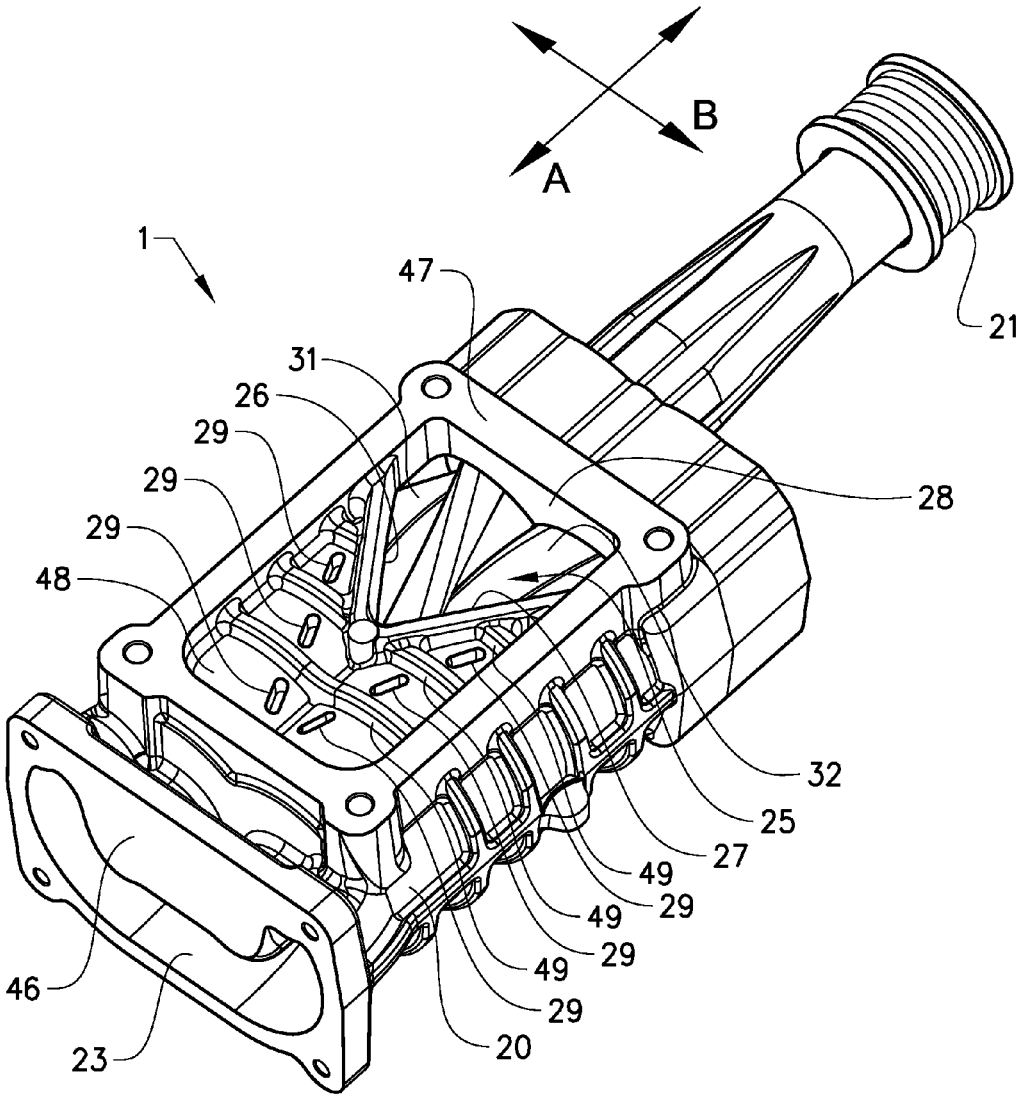
FIG. 2 shows an external, perspective view of the inventive Roots-type blower.

FIG. 2 shows an external, perspective view of a first embodiment of the Roots-type blower 1, according to the present disclosure, having a longitudinal direction A and a transverse direction B. The Roots-type blower 1 includes a housing 20. Air enters the blower 1 via the inlet port 23 which is defined by an opening adjacent one end of the housing 20. An inlet flange 46 surrounds the inlet port 23 and provides means for connection to inflow duct 5. An outlet port 25 is provided on the upper side of housing 20. In this example, the single outlet port 25 is defined partly by an end surface 28 which extends in the transverse direction B and a pair of inclined side surfaces 26, 27, such that the outlet port 25 has a substantially triangular shape. The inclined side surfaces 26, 27 are inclined with respect to the longitudinal direction A. The inclination angle is preferably selected to correspond to the helix angle of two rotors 31, 32 rotatably positioned within the housing 20. An outlet flange 47 surrounds the outlet port 25 and provides means for connection to the outflow duct 6. The outlet flange 47 has a rectangular form and encloses an area significantly larger than the flow area of the outlet port 25. The exterior surface 48 of the housing 20 occupies the area enclosed within the outlet flange 47 that is not part of the outlet port 25. The housing is reinforced by means of a plurality of transversally extending reinforcement ribs 49 that are spaced apart in the longitudinal direction A.

A first rotor 31 and a second rotor 32 are partly glimpsed through the outlet port 25. As the lobed rotors 31, 32 rotate, fluid is trapped in pockets, herein referred to as control volumes, enclosed by consecutive lobes and carried from the inlet port 23 to the outlet port 25 as the rotors rotate. To provide improved pressure equalization between consecutive control volumes prior to opening to the outlet port 25, the housing is provided with backflow slots 29 which allow the control volume to at least partly equalize in pressure with the outflow duct 6 prior to opening to the outlet port 25. The mechanical input to drive the rotors 31, 32 is by means of a pulley 15 adapted for engagement with a driving belt 7.

Figure 3:
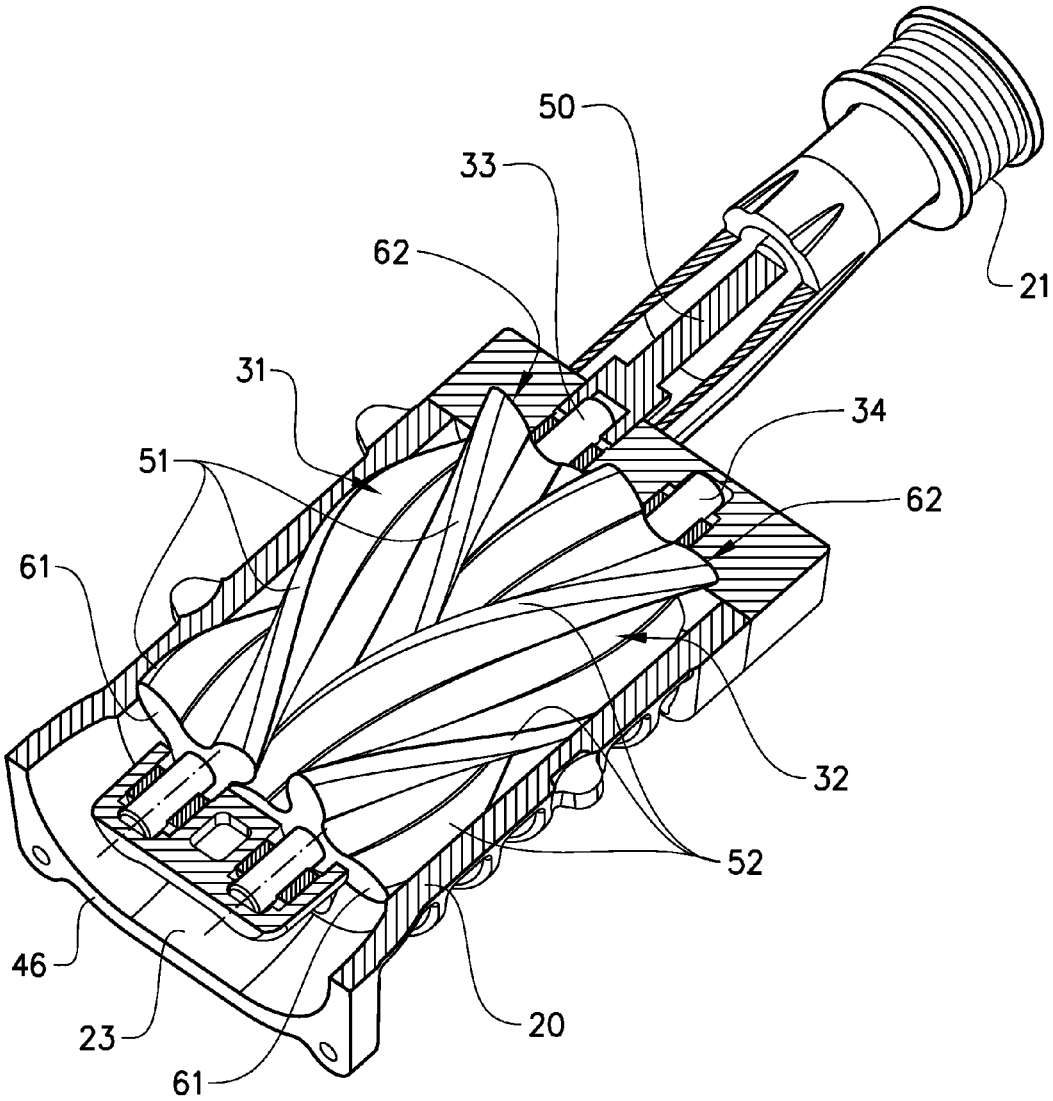
FIG. 3 shows a perspective overview of the rotors of the inventive Roots-type blower of FIG. 2.

FIG. 3 shows a cross-section of the blower housing 20 of FIG. 2, as well as the complete rotors 31, 32. The rotors 31, 32 comprise a first and a second rotor shaft 33, 34 respectively. Each rotor shaft 33, 34 is rotatably supported by bearing arrangements in the housing 20. The twist angle of the rotors is in the shown example 160 degrees. The twist angle refers to the difference in angular orientation of any lobe at a first axially facing end surface 61 and a second axially facing end surface 62. In this example, each rotor 31, 32 has four lobes 51, 52. The first rotor 31 is connected to the pulley 21 via a shaft 50.

Figure 4:
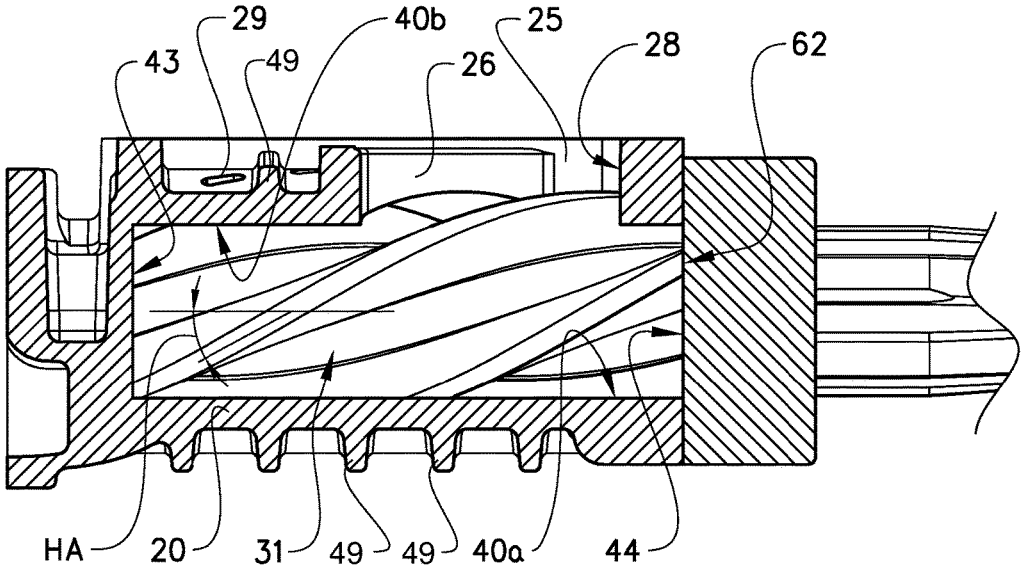
FIG. 4 shows a longitudinal cross-section of the Roots-type blower shown in perspective in FIG. 2.
Figure 5:
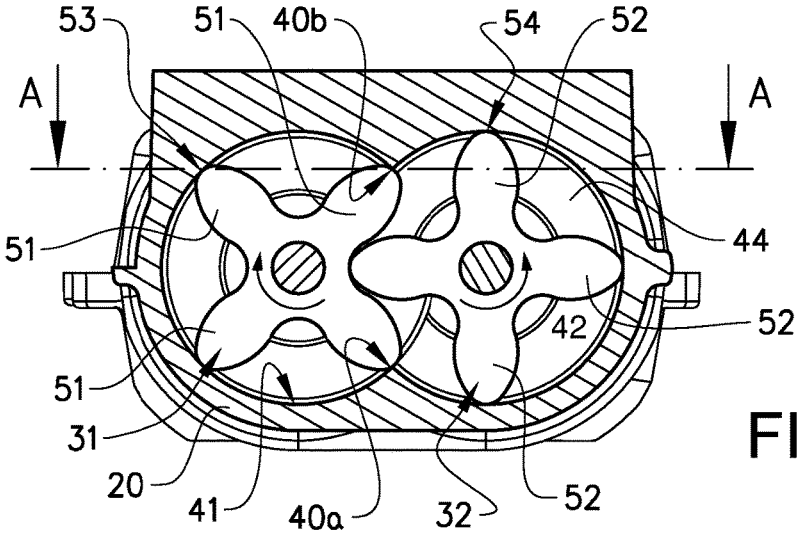
FIG. 5 shows a transverse cross-section of the Roots-type blower in FIG. 2.

The internal design of the blower will now be described more in detail, wherein FIG. 4 show a centrally located cross-section of the blower in the longitudinal direction A and FIG. 5 shows a corresponding cross-section of the blower in the transverse direction B. The blower housing 20 defines a pair of transversely overlapping cylindrical chambers 41, 42. The cylindrical chambers 41, 42 overlap at an inlet cusp 40*a* which is in-line with the inlet port 23 and at an outlet cusp 40*b* which is in-line with and interrupted by the outlet port 25. At a first end of the cylindrical chambers 41, 42, the housing 20 defines a first end wall 43 which comprises the inlet port 23. At the opposite end of the chambers 41, 42, the housing 23 defines a second end wall 44. The outlet port 25 is formed at an intersection of the first and second chambers 41, 42, adjacent the second end wall 44.

Referring now primarily to FIG. 5, it may be seen that disposed within the first cylindrical chamber 41 is a first rotor 31 and disposed within the second cylindrical chamber 42 is a second rotor 32. When viewing the rotors from the inlet as in FIG. 5, the first rotor 31 rotates clockwise while the second rotor rotates counter-clockwise. The first rotor 31 includes four lobes 51 and the second rotor 32 includes four lobes 52. The first and second axially facing end surfaces 61, 62 of the lobes sealingly cooperate with the first and second end walls 43, 44 of the housing 23, and the top land 53, 54 of each lobe sealingly cooperate with the cylindrical chambers 41, 42 which is well known in the art. Air which flows into the cylindrical chambers 41, 42 via the inlet port 23 will flow into a volume, which is defined by two consecutive adjacent lobes 51, 52 of the same rotor 31, 32. As used herein, such a volume is referred to as a "control volume". The air contained in a control volume will be carried by its respective lobes as the rotor rotates until the control volume is in communication with the outlet port 25. In other words, the term "control volume" refers, primarily, to the region or volume between two adjacent unmeshed lobes, after the trailing lobe has traversed the inlet cusp 40*a*, and before the leading lobe has traversed the outlet cusp 40*b*. A more detailed description of the movements of the lobes and the corresponding control volumes is provided in for example US 2006/0263230 A1.

Figure 6:
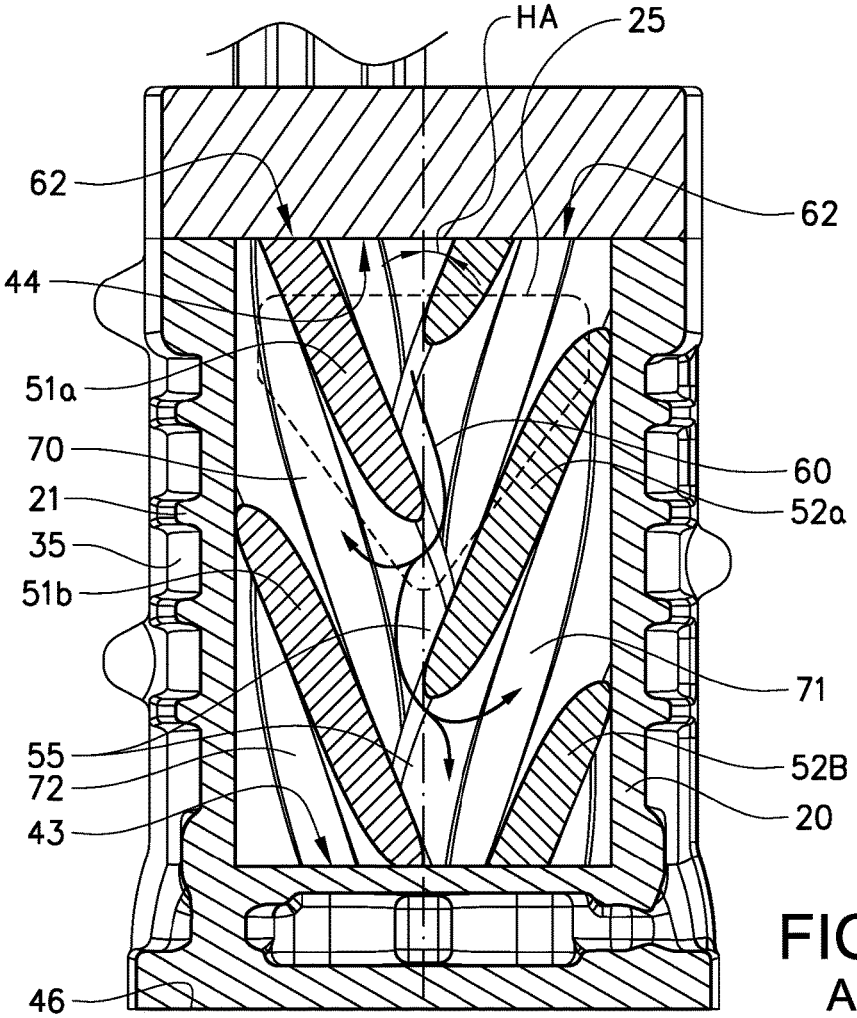
FIG. 6 shows a cross-section along line A-A in FIG. 5.

FIG. 6 shows a cross-sectional cut along line A-A in FIG. 5 for illustrating the internal leakage that inherently results from a Roots-type blower having a relatively large twist angle. As the rotors 31, 32 rotate, the lobes 51, 52 move into and out of mesh. In connection with meshing of two lobes 51, 52, one or more blowholes 55, sometimes referred to as a backflow ports, are formed along the outlet cusp 40*b*. A blowhole 55 is an opening through which a preceding control volume is permitted to communicate with an adjacent control volume. Consequently, blowholes 55 provide a possibility for a control volume to equalize in pressure with an adjacent control volume prior to opening to the outlet port 25. As understood by those skilled in the art, the formation of blowholes 55 occurs in a cyclic manner, i.e., one blowhole 55 is formed by two meshing lobes 51, 52. The blowhole 55 moves linearly in a direction towards the outlet port 25 as the lobe mesh moves linearly in the same direction. There can be several blowholes 55 present in the Roots-type blower 1 at any one time. The greater the twist angle of the lobes 51, 52, the more blowholes 55 will be present at the same time, and each blowhole will exhibit a larger area. Also, a greater twist angle means a greater helix angle HA of the lobes 51, 52 if the length of the rotors is kept constant. As the helix angle HA increases the linear velocity of the lobe mesh decreases and consequently the linear velocity of the blowholes 55 decreases. This results in each blowhole 55 being present during a longer period of time which means that there is longer time for pressure equalization between adjacent control volumes. Also, many blowholes 55 present at the same may provide pressure equalization between a plurality of adjacent control volumes. Hence, an increased helix angle, which usually is enabled by increased twist angle, provides improved pressure equalization between the control volumes prior to opening to the outlet port 25.

In FIG. 6, a leakage flow 60 is illustrated entering the outlet port 25 and flowing through a first blowhole 55 formed between a first lobe 51*a* of the first rotor 31 and a first lobe 52*a* of the second rotor 32, thereby enabling a certain level of pressure equalization between the pressure downstream the outlet port 25 and a first control volume 70, which is defined by a first and second lobe 51*a*, 51*b* of the first rotor 31. The leakage flow 60 may subsequently continue from the first control volume 70 to a second control volume 71, which is defined by a first and second lobe 52*a*, 52*b* of the second rotor 32, thereby enabling a certain level of pressure equalization between the pressure downstream the outlet port 25 and the first and second control volumes 70, 71. The top land of the first lobe 52*a* of the second rotor 32 has in this example not yet traversed the boundary of the outlet port 25. A third control volume 72 trailing the first control volume 70 of the first rotor 31 is still closed to the leakage flow 60.

Figure 7:
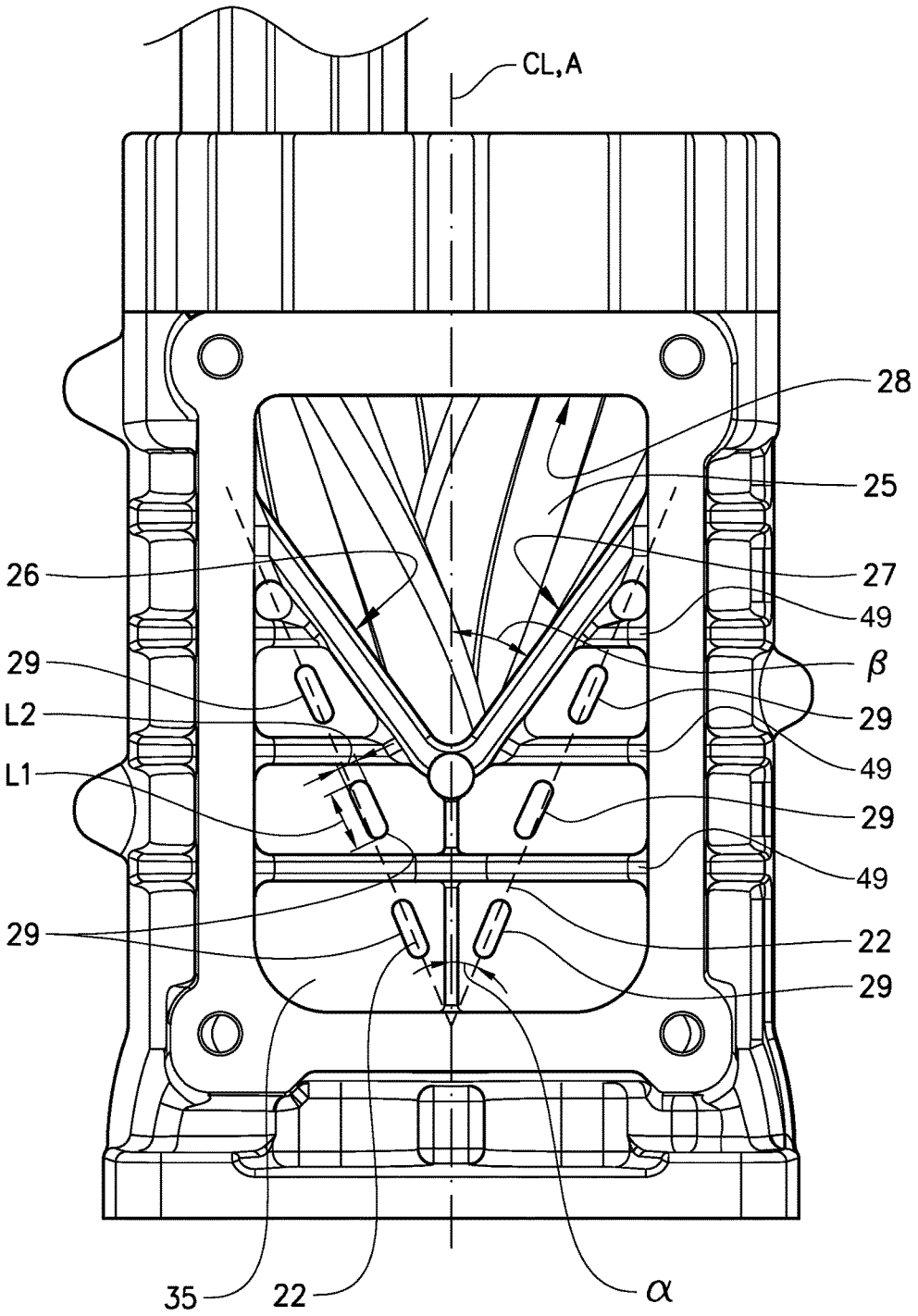
FIG. 7 shows a top view of the outlet flange of the inventive Roots-type blower of FIG. 2.

FIG. 7 shows a top view of the first embodiment of the Roots-type blower 1. In this example, three backflow slots 29 are provided on each side of an axially extending center line CL in a wall of the housing 20, i.e. in total six backflow slots. The center line CL extends in the longitudinal direction A in the center between the first and second rotor 31, 32, as viewed from the outlet port side of the housing in FIG. 7. Each backflow slot 29 is an opening extending through the housing 20 for effectuating a leakage of fluid between a control volume and a volume outside of the outlet port 25. At each side of the outlet port 25, the three backflow slots are provided substantially along a slot axis 22 which makes an angle $\alpha$ to the longitudinal direction A of the housing 20. The slots 29 may have their elongation axis arranged parallel with the associated slot axis 22. The center of each slot 29 may be located on the slot axis. Alternatively, the center of one or more slots 29 may be slightly displaced from the slot axis 22. The longitudinal direction A of the housing 20 coincides with a longitudinal axis of the rotors 31, 32. In this example, the slot axis angle $\alpha$ is smaller than the helix angle HA of the lobes 51, 52 such that the backflow slots 29 one after the other are brought into contact with the control volume as the top land 53, 54 of the lead lobe 51, 52 of the control volume progressively traverses the slot axis 22. Consequently, the two backflow slots 29 located closest to the inlet port will first provide a backflow passage, thereafter the four backflow slots 29 located closest to the inlet port will provide a backflow passage, and thereafter all six backflow will provide a backflow passages. In this example, there are six backflow slots 29 located in a V-shaped formation around the outlet port 25. Each backflow slot 29 has an elongated, substantially rectangular shape. The backflow slot 29 has an elongated shape and a length L1 in range of 3-25 millimeters, preferably 4-20 millimeters, and more preferably 4-15 millimeters. Furthermore, the backflow slot 29 has preferably a width L2 in range of 1-5 millimeters, more preferably 1-3 millimeters. However, other numbers, shapes and positions of backflow slots 29 are also possible. Preferably, the design, disclosure, number, size, shape, and position, of the backflow slots 29 is adapted to minimize noise in the specific environment of the Roots-type blower, disclosure, in a specific model of a vehicle. The frequency of the fundamental tone of the noise generated by the Roots-type blower corresponds to the rotational frequency of the rotors 31, 32. Several overtones, i.e., multiples of the fundamental frequency, are also generated. The size and shape of the backflow slots 29 effect which overtones that are generated. The inclination angle $\beta$ of the side surfaces 26, 27 is here indicated.

Figure 8:
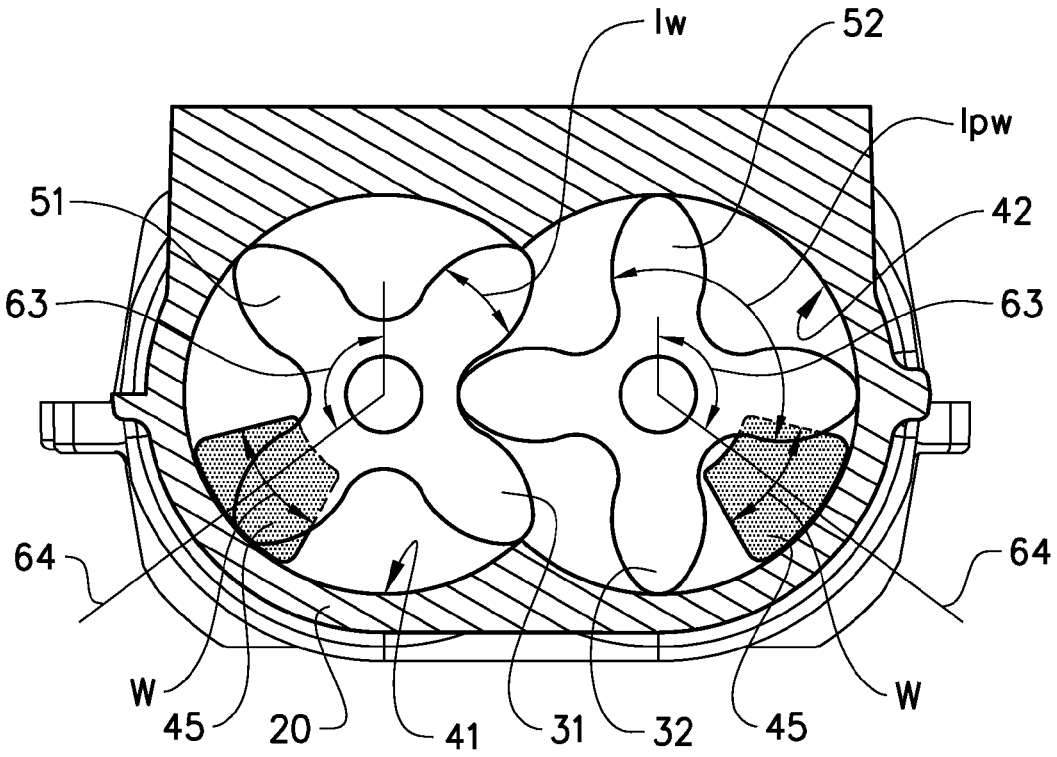
FIG. 8 shows a transverse cross-section of a second embodiment of the inventive Roots-type blower.

FIG. 8 shows a transverse cross-section of a second embodiment of the Roots-type blower according to the disclosure. In this embodiment, the second end wall 44 of the cylindrical chambers 41, 42 is provided with two bleed recesses 45, one in each cylindrical chamber 41, 42. Each bleed recess 45 has typically a depth of a few millimeters, disclosure, 2-10 mm, but smaller, larger or variable depths are also possible. The angular width w of the bleed recess 45 is larger than the angular width lw of the lobes 51, 52, such that the bleed recess 45 provides a passage between the end surface of the lobe 51, 52 and the second end wall 44. This passage enables fluid to leak between two adjacent control volumes. The angular width w of the bleed recess 45 is typically in the range of 1.1-2.0 times larger than the angular width lw of the lobes 51, 52. The angular width of a lobe 51, 52 or bleed recess 45 is defined as the average width of the lobe 51, 52 or bleed recess 45. The width w of the bleed recess 45 is typically smaller than the lobe pair width lpw, i.e. the total width of a pair of lobes, in order not to provide passage between three control volumes. The position, size and form of the recess is selected according to the specific circumstances. A three lobed rotor generally requires a wider bleed recess due the wider lobe width lw, etc. The positioning and size of the bleed recess is preferably also selected to avoid that working fluid may bleed from the outlet port to the inlet port. In the specific example shown in FIG. 8, the bleed recess may have a width w in the range of 45-90 degrees, preferably in the range of 60-80 degrees. An angle between an angular center 64 of the bleed recess 45 and a position where the lobe is directed towards the outlet port, in the direction of rotation, may be in the range of 90-180 degrees, preferably in the range of 110-150 degrees. The second embodiment may be successfully implemented on blowers having a large variety of twist angles and a helix angles HA, for example with a twist angle in the range of 0-360 degrees.

The term helix angle herein referrers to the angle between a lobe and the axis of the rotor on which the lobe is provided. The helix angle is typically calculated at the pitch circle (or pitch diameter) of the rotors. The term twist angle herein refers to the angle described by a lobe when "travelling" from one end surface to the other end surface of the rotor.

As will be realized, the disclosure is capable of modification in various obvious respects, all without departing from the scope of the appended claims. For example, each bleed recess may be divided into two or more bleed recesses having different angular extensions and/or positions, the location of the inlet port and outlet port may be modified. Accordingly, the drawings and the description thereto are to be regarded as illustrative in nature, and not restrictive. Additionally, the features of various implementing embodiments may be combined to form further embodiments of the invention.

What is claimed is:

1. A Roots-type blower comprising:

a housing defining first and second transversely overlapping cylindrical chambers, the housing comprising a first end wall and a second end wall, and the housing defining at least one inlet port in the first end wall and at least one outlet port at an intersection of the first and second chambers, adjacent the second end wall;

first and second meshed, lobed rotors disposed, respectively, in the first and second cylindrical chambers, each rotor including a plurality of lobes, each lobe having first and second axially facing end surfaces sealingly cooperating with the first and second end walls, respectively, and a top land sealingly cooperating with a respective cylindrical chamber, each lobe having its first and second axially facing end surfaces defining a twist angle of at least 90°, and each lobe defining a helix angle;

a plurality of control volumes for transfer of fluid from the at least one inlet port to the at least one outlet port, each control volume being defined by a pair of adjacent lobes on one of the rotors, and at least one of the cylindrical chambers, the first end wall, or the second end wall;

a leakage mechanism for effecting a leakage of fluid between adjacent control volumes, the leakage mechanism including blowholes formed within the cylindrical chambers in connection with meshing of the lobes of the first and second rotors; and an additional leakage mechanism comprising at least two individual backflow slots provided on each side of a center line of the housing, each backflow slot extending through a wall of the housing for effecting a leakage of fluid from downstream of the at least one outlet port into a control volume prior to traversal of boundaries of the at least one outlet port by the top land of a lead lobe of the control volume, wherein the individual backflow slots on either side of the center line are arranged along a slot axis having a slot axis angle to a longitudinal direction of the housing, and wherein the slot axis angle is smaller than the helix angle of the lobes, such that the individual backflow slots along each slot axis sequentially enable a fluid flow passage to a control volume as the top land of the lead lobe of the control volume progressively traverses the slot axis.

2. The Roots-type blower according to claim 1 wherein the additional leakage mechanism comprises at least three individual backflow slots provided on each side of the center line of the housing.

3. The Roots-type blower according to claim 1 wherein each backflow slot has a rectangular shape.

4. The Roots-type blower according to claim 1 wherein each backflow slot has an elongated shape having a length in the range of 3-25 millimeters.

5. The Roots-type blower according to claim 1 wherein each backflow slot has an elongated shape having a length in the range of 4-20 millimeters.

6. The Roots-type blower according to claim 1 wherein each backflow slot is provided on either side of the at least one outlet port.

7. The Roots-type blower according to claim 1 wherein the housing comprises a reinforcing rib projecting outwardly from an exterior surface of the housing and extending in a direction perpendicular to a longitudinal direction, and the at least two individual backflow slots provided on each side of the center line are provided on each side of the reinforcing rib.

8. The Roots-type blower according to claim 1 wherein a blowhole between adjacent control volumes is formed in regions along a longitudinal direction of the blower when the lobe of any rotor is located between an angular position where the top land has passed an outlet cusp and an angular position where the lobe sealingly closes the control volume upon meshing with lobes of the other rotor.

9. A Roots-type blower comprising:

a housing defining first and second transversely overlapping cylindrical chambers, the housing comprising a first end wall and a second end wall, and the housing defining at least one inlet port in the first end wall and at least one outlet port at an intersection of the first and second chambers, adjacent the second end wall;

first and second meshed, lobed rotors disposed, respectively, in the first and second cylindrical chambers, each rotor including a plurality of lobes, each lobe having first and second axially facing end surfaces sealingly cooperating with the first and second end walls, respectively, and a top land sealingly cooperating with a respective cylindrical chamber, each lobe having its first and second axially facing end surfaces defining a twist angle and each lobe defining a helix angle;

a plurality of control volumes for transfer of fluid from the at least one inlet port to the at least one outlet port, each control volume being defined by a pair of adjacent lobes on one of the rotors, and at least one of the cylindrical chambers, the first end wall, or the second end wall; and a leakage mechanism for effecting a leakage of fluid between adjacent control volumes, the leakage mechanism comprising at least one bleed recess provided in the second end wall, wherein the at least one bleed recess provides a passage between the second axially facing end surface of a lobe and the second end wall such that fluid is enabled to leak between adjacent control volumes, and wherein the at least one bleed recess is located to enable a leakage of fluid between adjacent control volumes only after each of the adjacent control volumes is lacking fluid communication with the at least one inlet port.

10. The Roots-type blower according to claim 9 wherein at least two bleed recesses are provided in the second end wall, and wherein at least one bleed recess is associated with each individual cylindrical chamber.

11. The Roots-type blower according to claim 10 wherein each of the at least two bleed recesses has an angular width greater than an angular width of a lobe.

12. The Roots-type blower according to claim 9 wherein the twist angle of each lobe is at least 120°.

13. The Roots-type blower according to claim 9 wherein the twist angle of each lobe is at least 140°.

14. The Roots-type blower according to claim 9 wherein the twist angle of each lobe is less than 360°.

15. The Roots-type blower according to claim 9 wherein the twist angle of each lobe is less than 300°.

16. The Roots-type blower according to claim 9 wherein the twist angle of each lobe is less than 240°.

17. A Roots-type blower comprising:

a housing defining first and second transversely overlapping cylindrical chambers, the housing comprising a first end wall and a second end wall, and the housing defining at least one inlet port and at least one outlet port;

first and second meshed, lobed rotors disposed, respectively, in the first and second cylindrical chambers, each rotor including a plurality of lobes, each lobe having first and second axially facing end surfaces sealingly cooperating with the first and second end walls, respectively, and a top land sealingly cooperating with a portion of the housing that defines a respective cylindrical chamber, each lobe having its first and second axially facing end surfaces defining a twist angle of at least 90°, and each lobe defining a helix angle;

a plurality of control volumes for transfer of fluid from the at least one inlet port to the at least one outlet port, each control volume being at least partially defined by a pair of adjacent lobes on one of the rotors;

a leakage mechanism for effecting a leakage of fluid between adjacent control volumes, the leakage mechanism including blowholes formed within the cylindrical chambers in connection with meshing of the lobes of the first and second rotors; and an additional leakage mechanism comprising at least two individual backflow slots provided on each side of a center line of the housing, each backflow slot extending through a wall of the housing for effecting a leakage of fluid from downstream of the at least one outlet port into a control volume prior to traversal of boundaries of the at least one outlet port by the top land of a lead lobe of the control volume, wherein the individual backflow slots on either side of the center line are arranged along a slot axis having a slot axis angle to a longitudinal direction of the housing, and wherein the slot axis angle is smaller than the helix angle of the lobes, such that the individual backflow slots along each slot axis sequentially enable a fluid flow passage to a control volume as the top land of the lead lobe of the control volume progressively traverses the slot axis.

18. The Roots-type blower according to claim 17 wherein the at least one inlet port is formed in the first end wall, and the at least one outlet port is formed at an intersection of the first and second chambers.

19. The Roots-type blower according to claim 17 wherein the additional leakage mechanism comprises at least three individual backflow slots provided on each side of the center line of the housing.

20. The Roots-type blower according to claim 17 wherein each backflow slot has a rectangular shape.

* * * * *